US006606957B2

(12) United States Patent
Matthews

(10) Patent No.: US 6,606,957 B2
(45) Date of Patent: Aug. 19, 2003

(54) EXTENDABLE DECK OR ROOM FOR A WATERCRAFT

(76) Inventor: David G. Matthews, 1120 Crestview Dr., Pigeon Forge, TN (US) 37863

( * ) Notice: Subject to any disclaimer, the term of this patent is extended or adjusted under 35 U.S.C. 154(b) by 0 days.

(21) Appl. No.: 09/811,907

(22) Filed: Mar. 19, 2001

(65) Prior Publication Data

US 2002/0129757 A1 Sep. 19, 2002

(51) Int. Cl.[7] ..... B63B 3/00

(52) U.S. Cl. ..... 114/85; 114/71; 114/124

(58) Field of Search ..... 114/71, 85, 361, 114/363, 343, 364, 124, 39.28, 61.15, 61.16, 362

(56) References Cited

U.S. PATENT DOCUMENTS

| | | | | |
|---|---|---|---|---|
| 2,669,733 A | | 2/1954 | Picker | |
| 3,052,896 A | | 9/1962 | Beach | |
| 3,229,833 A | | 1/1966 | Heck et al. | |
| 3,417,720 A | * | 12/1968 | Covell, Jr. | 114/124 |
| 3,475,773 A | | 11/1969 | Codman | |
| 3,511,393 A | | 5/1970 | Abromavage et al. | |
| 3,613,137 A | | 10/1971 | Eccles | |
| 3,805,722 A | | 4/1974 | Melchert, Jr. et al. | |
| 3,870,011 A | * | 3/1975 | Cooper | 440/11 |
| 4,085,473 A | | 4/1978 | Franklin | |
| 4,293,967 A | | 10/1981 | Ord | |
| 4,354,447 A | | 10/1982 | Hultgren | |
| 4,624,619 A | | 11/1986 | Uher | |
| 4,854,534 A | | 8/1989 | Porter | |
| 4,971,315 A | | 11/1990 | Rector | |
| 4,993,341 A | | 2/1991 | Merkel | |
| 5,085,165 A | | 2/1992 | Reed | |
| 5,123,372 A | | 6/1992 | Kobayashi et al. | |
| 5,136,963 A | | 8/1992 | Zuzik | |
| 5,170,741 A | | 12/1992 | Magers et al. | |
| 5,542,370 A | | 8/1996 | Castleberry | |
| 5,924,377 A | * | 7/1999 | Rausch et al. | 114/77 R |
| 6,058,866 A | | 5/2000 | May | |
| 6,325,437 B2 | * | 12/2001 | Hiebert et al. | 296/165 |

FOREIGN PATENT DOCUMENTS

| | | | |
|---|---|---|---|
| JP | 61-166789 | * | 7/1986 |
| JP | 61271191 | | 12/1986 |
| JP | 61271195 | | 12/1986 |
| WO | WO 91/01249 | | 2/1991 |

* cited by examiner

*Primary Examiner*—Ed Swinehart
(74) *Attorney, Agent, or Firm*—Marshall, Gerstein & Borun

(57) ABSTRACT

A watercraft has a laterally extendable deck or room extension that is extended by sliding along guides or bearings. The deck or room extension can be extended using a motor, gear pinion and rack arrangement, a hand crank arrangement, a hydraulic cylinder arrangement, or a linear motor arrangement. A keel ballast can be utilized to counterbalance the eccentric load caused by the overhanging deck or room extension.

15 Claims, 5 Drawing Sheets

10
30, 32
36, 38
18
22
24
12
15
14

3
32
38
10
CL
72
71
60
64
62
58
12
18
70
73
36
52
48
67
66
44
30
3

EXTENDABLE DECK OR ROOM FOR A WATERCRAFT

TECHNICAL FIELD OF THE INVENTION

The present invention relates to watercraft, and in particular to deck structure or cabin structure for a boat.

BACKGROUND OF THE INVENTION

An extendable deck assembly for a boat is disclosed in U.S. Pat. No. 6,058,866. The extendable deck moves in a longitudinal direction to be deployed from the retracted to the extended position.

One advantage of employing an extendable deck for a boat is that when the deck is retracted, the perimeter of the boat is smaller than a perimeter defined by the extended position of the deck, and can therefore, be more easily maneuvered in a parking lot as well as on a lake. Once the boat is positioned on the lake, the extendable deck can be moved from a retracted to an extended position for an increased usable area on the boat.

The extendable deck disclosed in U.S. Pat. No. 6,058,866 extends in sliding fashion in the longitudinal direction. Due to the relatively greater length than width of the boat, the longitudinal direction is the most stable orientation or axis to apply an eccentric load, i.e., a load that is offset from the center of gravity of the boat. However, one disadvantage of extending a deck in the longitudinal direction is the fact that boats typically have a relatively narrow width profile, and extending the deck longitudinally would be limited to this narrow width profile.

It is generally understood that loads offset from the center of gravity of a boat in the lateral direction cause a greater tipping instability of the boat. It would not therefore be expected that a laterally extending deck system could be made effective. The present invention provides an effective laterally extending deck or cabin structure for a watercraft.

SUMMARY OF THE INVENTION

The present invention provides an extendable horizontal, passenger-supporting structure for a watercraft that is selectively extended laterally from the watercraft. The structure can be a deck that is extendable from a main deck of the watercraft, or from a roof portion of a watercraft, or from a low deck level of the watercraft. The structure can be an open air deck or a room that is substantially enclosed from the outside environment, extendable from the body of the watercraft.

The extendable structure can be guided on support rails and deployed in sliding fashion by a rack and pinion arrangement driven by a small motor. Alternately, the structure can be extended by a linear motor, by a hand crank and associated gearing, by a hydraulic piston arrangement, or by any other known arrangement for imparting a sliding force to a structure.

The present invention can be employed to dramatically increase the usable floor space on, or cabin space within, a watercraft.

In one embodiment, a pair of extendable deck portions are mounted slidably on a main deck of the watercraft. The deck portions are deployed in opposite directions to increase the usable deck space on the watercraft. The deck portions are guided on rails. The overhanging weight of the oppositely deployed deck portions mutually counterbalance to minimize tipping moments on the watercraft.

In another embodiment, the structure comprises oppositely deployed, enclosed rooms or compartments which are extendable in the lateral direction from the body or the watercraft, between the main deck and the waterline. The oppositely deployed rooms provide mutually counterbalancing loads to minimize tipping moments on the watercraft. The rooms can increase the floor space below deck when deployed. The rooms can be retracted so that the overall size of the watercraft is decreased for moving the watercraft on land or through the water.

According to another aspect of the invention, one or more rooms or compartments can be slidingly deployed from a watercraft body to increase the cabin area of the watercraft. Each room can be located vertically between a top of the body and the waterline, and can include a floor, sidewalls and a roof configured to be weather and water protected.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
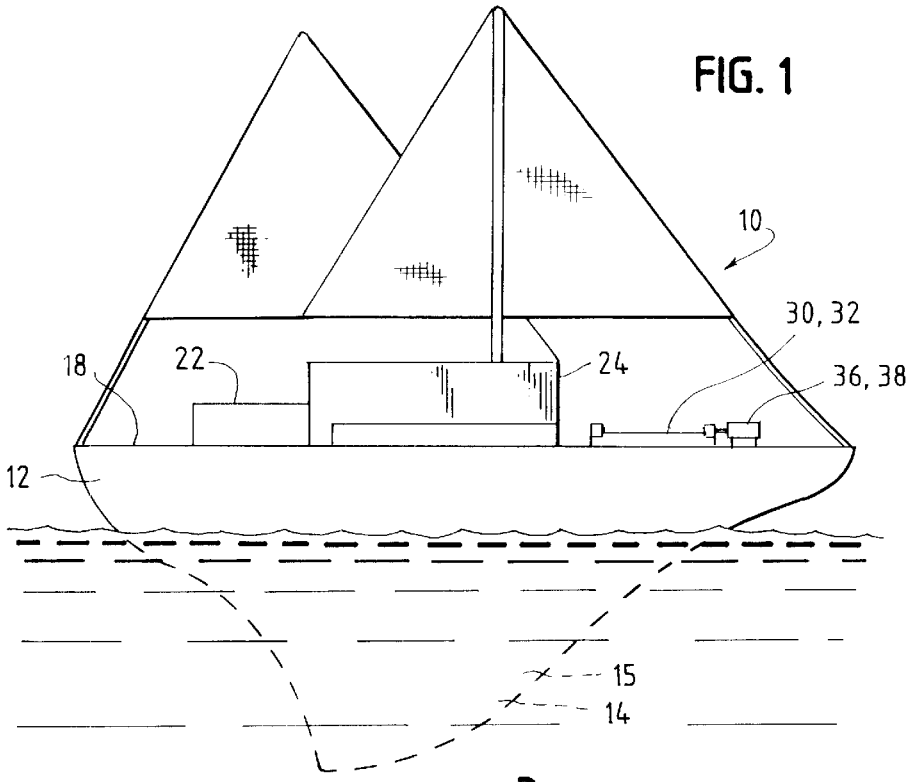
FIG. 1 is an elevational view of a watercraft incorporating the present invention.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIG. 1 illustrates a watercraft 10 such as a sail boat or power boat floating in a body of water such as a lake. The watercraft 10 includes a hull 12 being substantially hollow, and a weighted keel 14. The keel 14 is weighted with ballast which can be a mass or layer of concrete, lead, other metal, or some other dense material. The ballast is preferably located in the lowest region of the keel to increase tipping stability of the watercraft. The hull 12 includes a main deck 18 and an entryway 22 into a cabin 24. The cabin 24 extends through the main deck 18 into the hollow hull 12.

Laterally extendable deck portions 30, 32 (shown in FIG. 2) are mounted on the main deck 18. The deck portions 30, 32 are extended and retracted laterally by drive mechanisms 36, 38, respectively, as described below.

Figure 2:
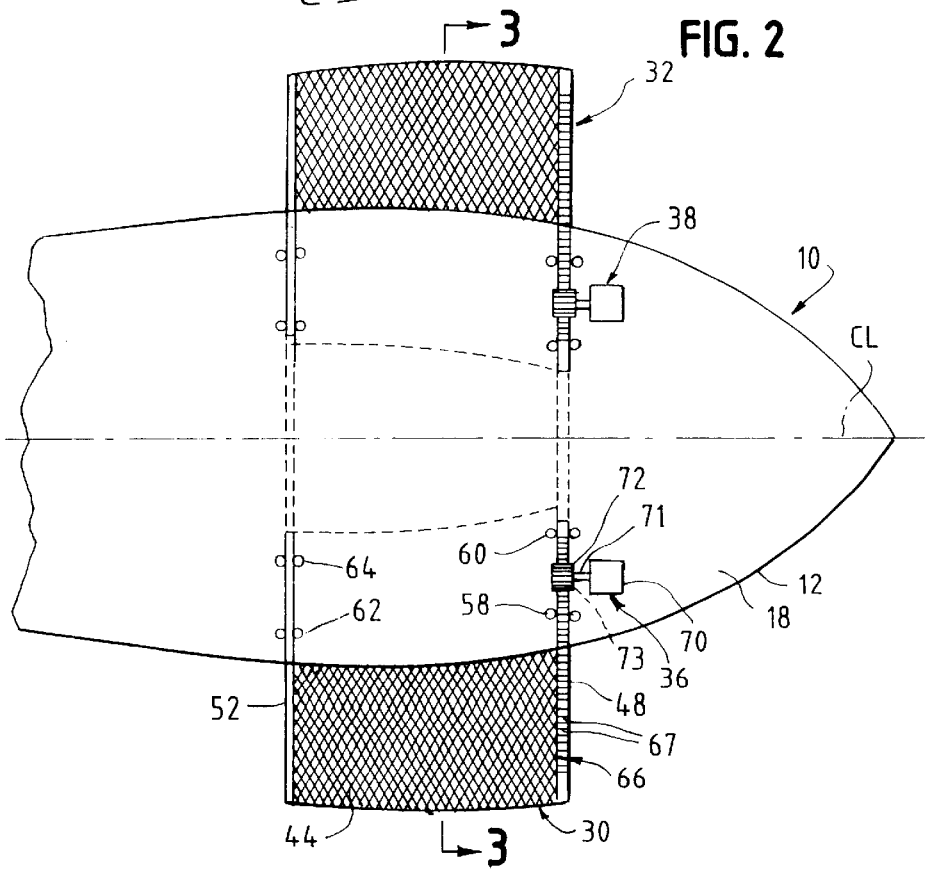
FIG. 2 is an enlarged, fragmentary plan view of the watercraft shown in FIG. 1.

FIG. 2 illustrates the deck portions 30, 32 extended laterally outwardly of a longitudinal centerline of the watercraft 10. Preferably, the deck portion 30 and driving arrangement 36 are substantially mirror image identical to the deck portion 32 and driving arrangement 38. Therefore, only the right side of FIG. 2 will be described in detail.

The deck portion 30 includes a platform surface 44 for supporting passengers. The platform surface 44 is connected to lateral beams or rails 48, 52 which each have a length substantially as wide as the platform surface 44 and extend inwardly therefrom to extend over the main deck 18. The deck portion 30 is supported in cantilever fashion from the main deck 18 by bearings 58, 60 (shown schematically) on the rail 48 and bearings 62, 64 on the rail 52 (shown schematically). The bearing pairs 58, 60; 62, 64 are configured to guide and to only allow lateral sliding of the rails 48, 52.

At least one of the rails, the rail 48 for example, has a rack surface 66 formed on a top thereof, the rack surface typically comprising a row of teeth 67. The driving arrangement 36 includes a rotary motor 70 driving a drive shaft 71 which drives a pinion gear 72 having gear teeth 73 which are enmesh with the teeth 67 on the rack surface 66. Thus, rotation of the drive shaft 71 by the motor 70 rotates the pinion gear 72 and translates the rail 48 laterally of the centerline CL of the watercraft.

In the position shown in FIG. 2, the deck portion 30 is fully extended outwardly. To retract the deck portion 30, the direction of rotation of the pinion gear 72 is selected to drive the deck portion 30 to the left as shown in FIG. 2. The motor 70 shown in FIG. 2 can be an electric motor, a hydraulic motor, a pneumatic motor or other type of powered motor.

It is also to be understood that although the deck portions 30, 32 are shown to be driven independently by the driving mechanisms 36, 38, a single motor driving a single pinion gear that is simultaneously enmesh with upper and lower racks, each of the racks being fixed to one of the decks 30, 32, could be used. The rotation of the motor pinion gear would thus simultaneously extend or retract (in opposite directions) the deck portions 30, 32. According to this arrangement, the tipping unbalance otherwise caused by one extended deck portion, is prevented, as the extended deck portions would be substantially counterbalanced.

Figure 3:
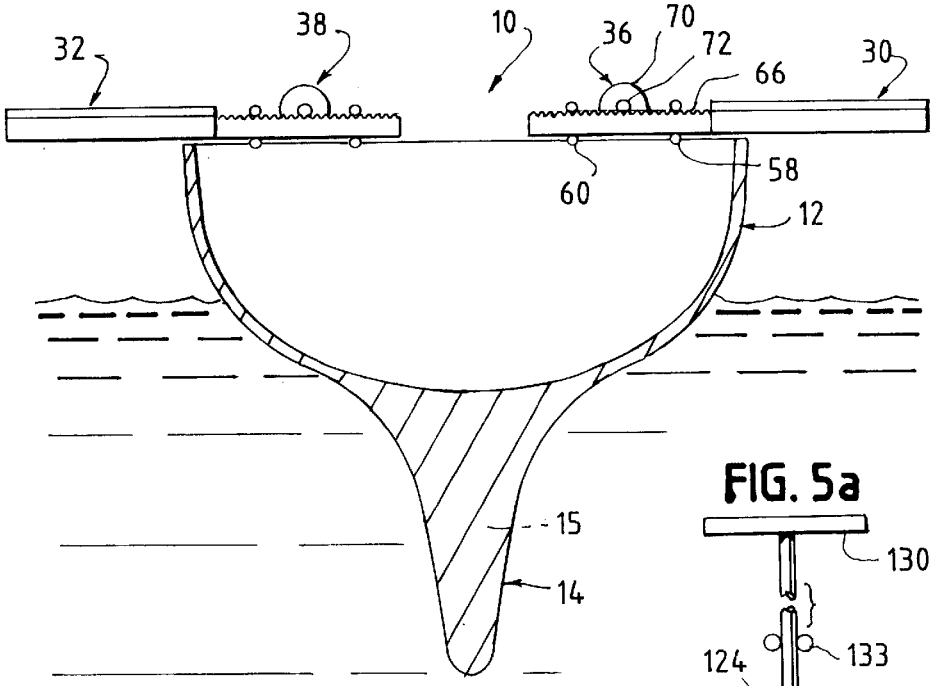
FIG. 3 is a sectional view taken generally along line 3—3 of FIG. 2.

FIG. 3 illustrates in cross section the deck portions 30, 32 extended by the driving mechanism 36, 38. The keel 14 is illustrated having the ballast 15 therein for resisting an overturning force on the watercraft 10.

While the mutual extension of the opposite deck portions 30, 32 provides a more balanced load on the watercraft 10, it is also within the scope of the invention to provide only one laterally extendable deck portion, such as the deck portion 30, which can be extended and retracted as shown, or to provide both deck portions 30, 32 and selectively extend either or both of the deck portions, without jeopardizing the stability of the watercraft.

For simplicity of description, some structural items, such as guard rails surrounding the deck portions 30, 32 and/or the main deck 18, are not shown in the Figures.

Figure 4:
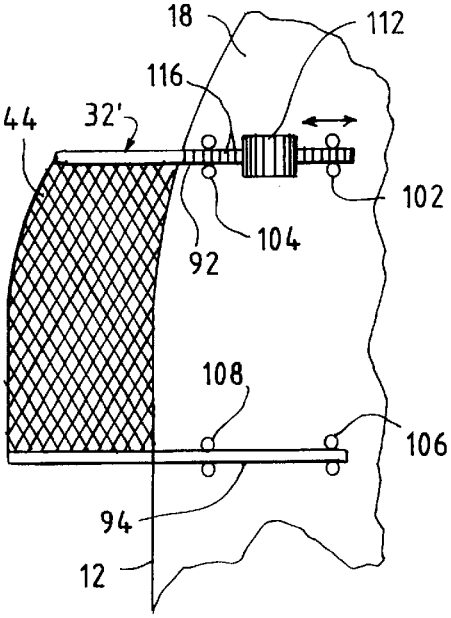
FIG. 4 is a fragmentary plan view of a alternate embodiment driving mechanism.

FIG. 4 illustrates an alternate deck portion 32' having the platform surface 44 connected slidably to the deck 18 by parallel laterally arranged rails 92, 94 which are guided to allow sliding of the rails but to support the platform surface 44 in cantilever fashion off the main deck 18. The bearings are shown schematically as 102, 104, 106, 108. The bearings are configured to allow only lateral sliding movement of the rails 92, 94. At least one of the rails, the rail 92, includes magnetic "teeth" 116. A linear motor 112 can be arranged to react to the magnetic teeth 116 on one of the rails 92 to selectively retract or extend the deck portion 32'. A more complete description of an electromagnetic linear motor is described in U.S. Pat. No. 5,602,431, herein incorporated by reference.

Figure 5A:
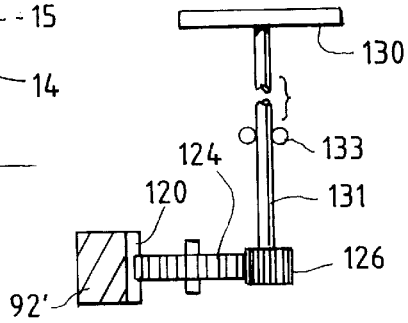
FIG. 5*a* is a sectional view taken generally along line 5*a*—5*a* of FIG. 5.
Figure 5:
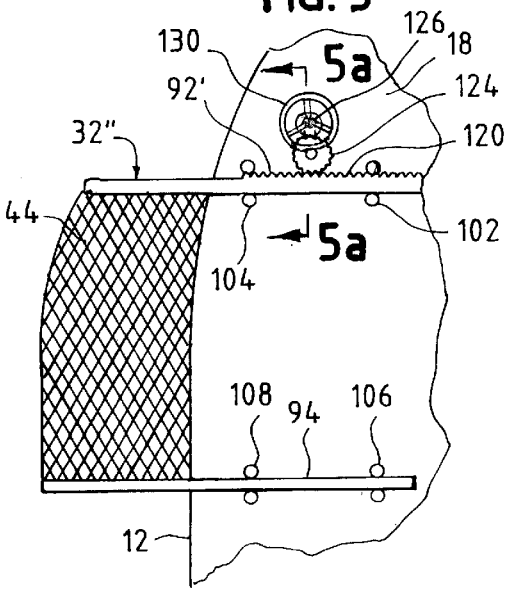
FIG. 5 is a fragmentary plan view of a further alternate driving mechanism.

FIG. 5 illustrates a further alternate embodiment deck portion 32'. In this embodiment the rail 92' includes a rack surface 120 engaged by a gear wheel 124. Gear wheel 124 is enmesh with a small gear wheel 126 which is driven into rotation by a hand wheel 130. Thus, the deck portion 32' can be extended or retracted by a user turning the hand wheel 130 to drive the small gear wheel 126 to drive the larger gear wheel 124 which, being enmesh with the rack surface 120, drives the rails 92', 94' to extend or retract the deck portion 32".

FIG. 5*a* illustrates the small gear 126 connected by a shaft 131 to the handwheel 130. The shaft is guided by a bearing 133 (shown schematically).

Figure 6:
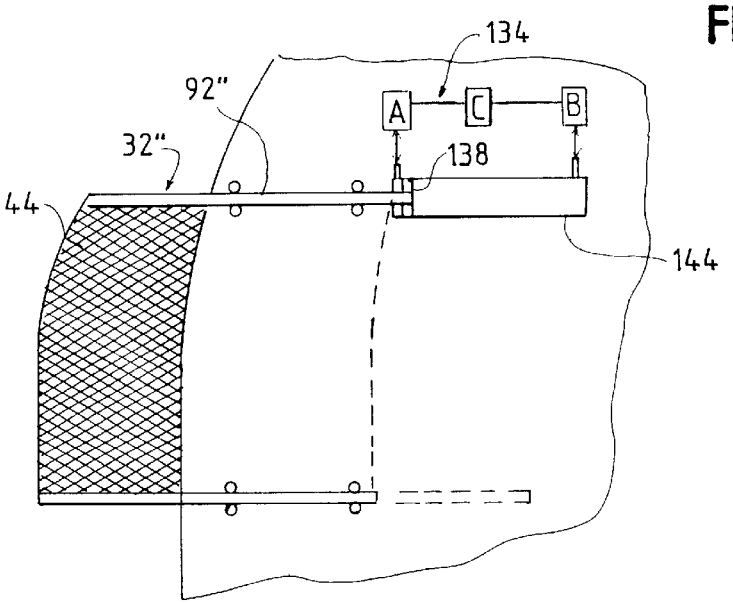
FIG. 6 is an enlarged fragmentary plan view of a further alternate driving mechanism.

FIG. 6 shows a further alternate embodiment deck portion 32" having an alternate driving mechanism 134. A rail 92" that is connected to the platform surface 44, includes on an end thereof, a piston element 138. The piston element 138 is contained within a hydraulic or pneumatic cylinder 144 of the driving mechanism 134. Depending on the desired direction of movement of the platform surface 44, pressurized media or fluid, liquid or gas, is delivered from location or source A or B and the respective other source A or B then receives a discharge of the hydraulic media as the piston 138 moves along the cylinder 144. Such a hydraulic arrangement can be accomplished using a four way solenoid valve and a double acting cylinder, known in the art.

Figure 7:
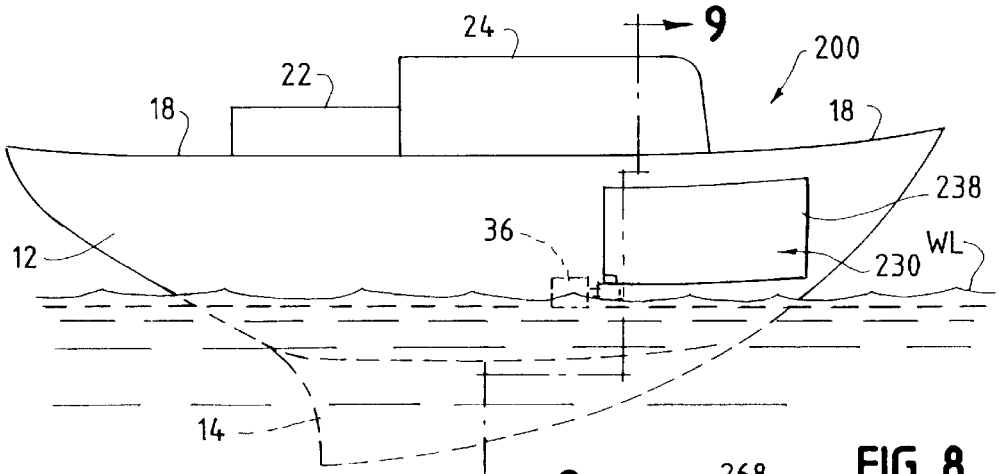
FIG. 7 is an elevational view of an alternate embodiment watercraft according to the present invention.
Figure 8:
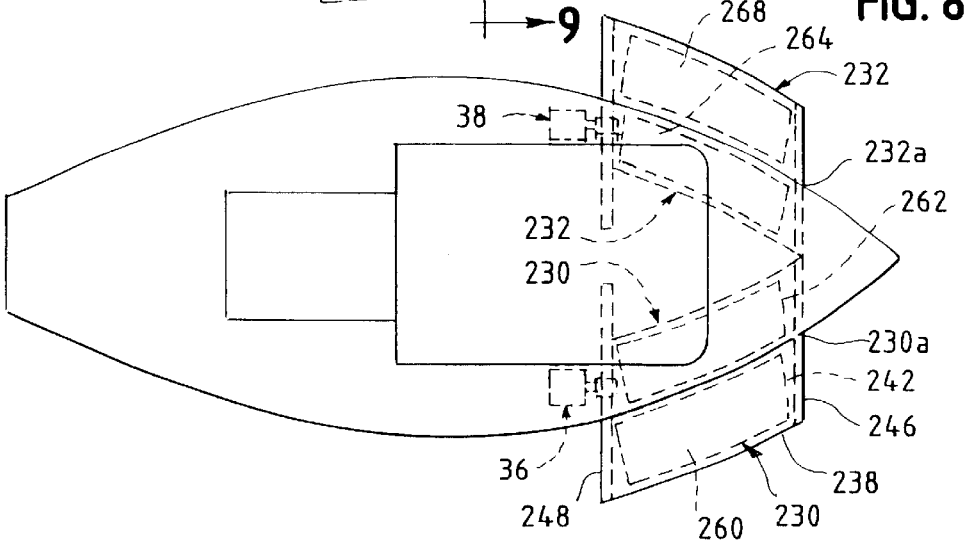
FIG. 8 is a plan view of a watercraft shown in FIG. 7.

FIGS. 7 and 8 illustrate an alternate embodiment of watercraft 200. The watercraft 200 has components which are like components to those itemized in FIG. 1, and are identified by identical reference numerals. In this embodiment, the hull 12 is provided with laterally extendable room portions or compartments 230, 232. Each of the room portions 230, 232 includes an outside wall 238 which is preferably shaped to conform to an outside surface of the hull 12 when in the retracted position. Each of the room portions 230, 232 includes a roof 242, side walls 246, 248, and a floor 252 (shown in FIG. 9). The room portions 230, 232 must be effectively weather sealed, and/or water sealed around the substantially rectangular joint between the room 230, 232, and the hull 12, the joint being designated 230*a*, 232*a*, respectively. The joints 230*a*, 232*a* must allow the lateral sliding of the rooms during extension and retraction.

Figure 9:
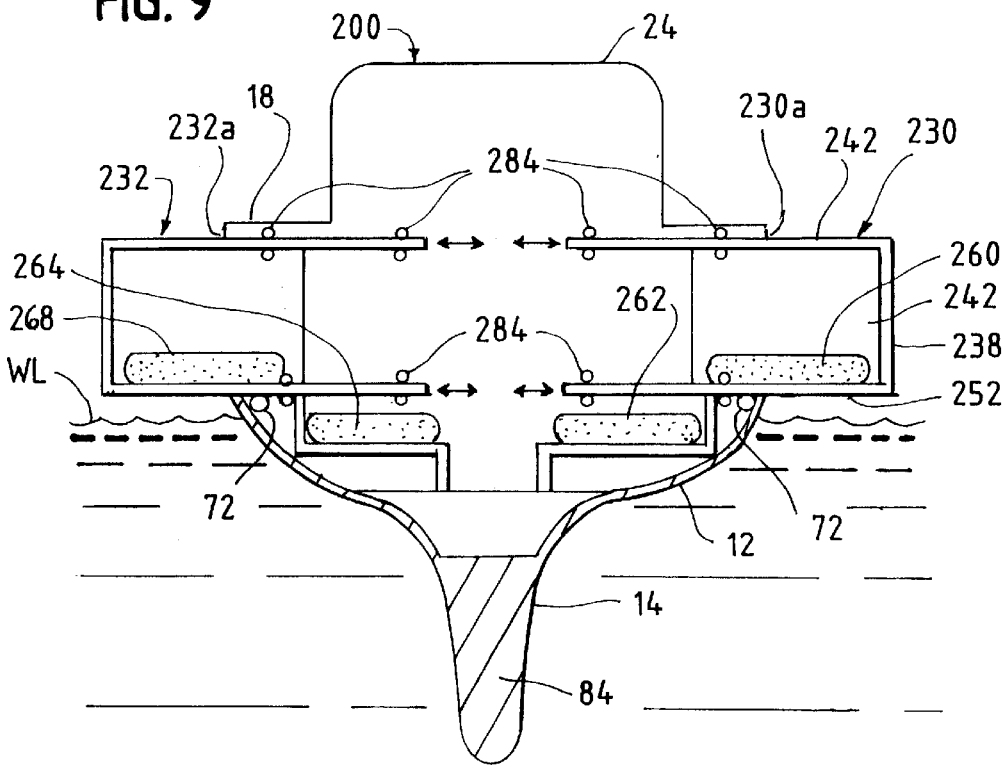
FIG. 9 is a sectional view taken generally along offset sectional line 9—9 of FIG. 7 illustrating room portions in extended positions.

FIG. 9 illustrates the room portions 230, 232 extended outwardly. By extending these rooms outwardly additional space inside the hull 12 and cabin 24 can be achieved. As an example only, by extending the room portions 230, 232 outwardly, four berths 260, 262, 264, 268, can be accommodated, whereas without the retractable room portions 230, 232 only two berths 262, 264 are possible.

Each room portion 230, 232 can be supported at its four lateral corners by four lateral rails. At least one lateral rail for the room 230 is driven by the driving mechanism 36, and at least one lateral rail of the room portion 232 is driven by the driving mechanism 38. All of the alternate embodiment driving mechanisms previously described for translating the deck portions 30, 32 are equally applicable to the room portions 230, 232. The four rails are guided for sliding movement and adequately supported for cantilever extension from the hull 12 or the main deck 18 by guides or bearings 284 applied at one or more positions along the length of the rails.

Figure 10:
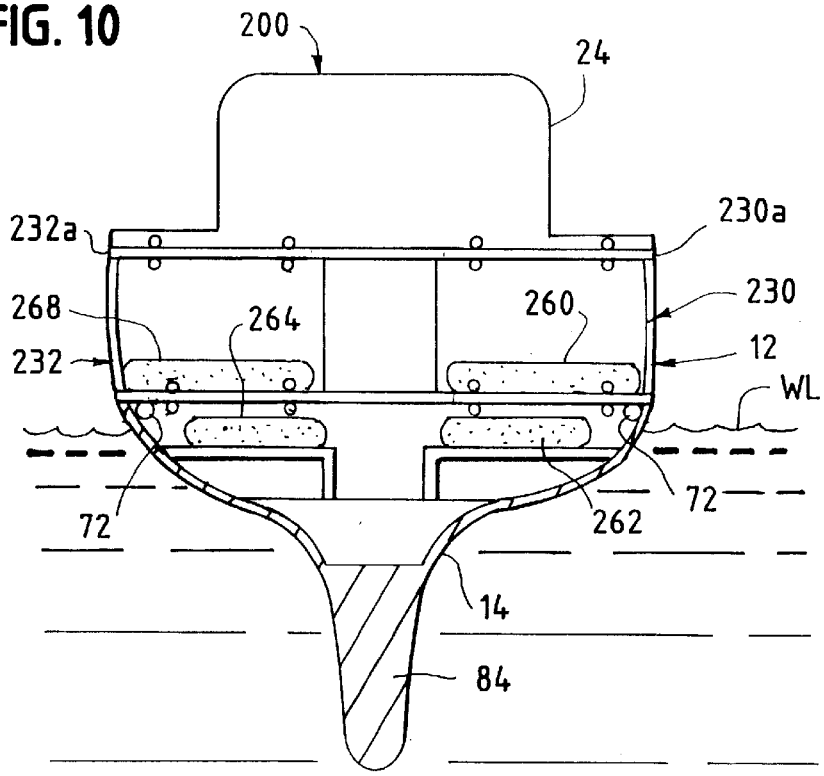
FIG. 10 is a sectional view similar to FIG. 9 but with the room portions of the watercraft in retracted positions.

FIG. 10 illustrates the rooms 230, 232 in retracted position with respect to the hull 12. In this position, the watercraft 200 is more streamlined, more easily maneuvered on land and through the water, and has an increased stability. It is therefore preferable that the configuration shown in FIG. 10 be used for road transport or when underway on a lake, and the configuration shown in FIG. 9 be used when the boat is still, on the lake.

Figure 11:
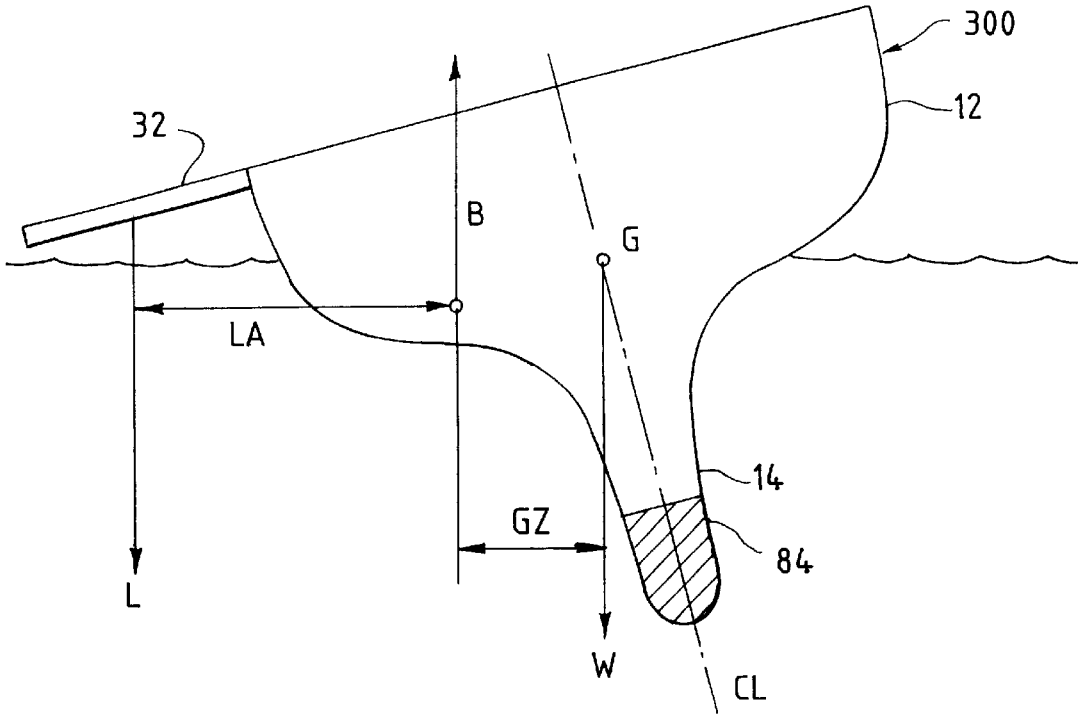
FIG. 11 is diagrammatic elevational view of a watercraft subjected to eccentric load.

FIG. 11 is a diagrammatic view of a watercraft 300 having a center of gravity G, a center of buoyancy B, and an applied eccentric load L from an extended lateral deck 32. When the watercraft 300 is fully upright, the center of gravity G and the center of buoyancy B are both located on the centerline CL. When the boat is tilted as shown (shown exaggerated), the buoyancy force acting on the center of buoyancy B is offset due to the shape of the hull 12, the left side of the of the hull dipping deeper into the water.

The distance GZ is the "righting arm" of the watercraft and is dependent on the width or "beam" of the hull 12 and the effectiveness of the ballast 84. The magnitude of the moment created by the righting arm must be sufficient to counterbalance the eccentric load L to prevent excessive tilting or "heeling" of the hull 12. Mathematically, the sum of the moments about the center of buoyancy B must be zero. The righting arm GZ moment which tends to right the boat, or a moment clockwise about the center of buoyancy B, must balance the load arm LA moment which tends to heel the boat counterclockwise about the center of buoyancy B, to achieve stability. Expressed mathematically:

$$L \times LA = W \times GZ$$

where W is the entire vertical load of the watercraft. It should be noted that the center of gravity G will be somewhat to the left of the centerline CL due to the additive affect of the load L on the weight W. However, where the added load L caused by the extended deck portion is small compared to the entire weight W of the watercraft (including ballast), approximating the center of gravity G to be on the centerline CL is not too far in error.

According to the invention, the width or "beam" of the watercraft and/or its ballast weight, and/or simply the location of its center of gravity, are configured to counterbalance the eccentric load of a laterally extending deck portion or room portion, including variable passenger loads, such that excessive tipping is prevented.

From the foregoing, it will be observed that numerous variations and modifications may be effected without departing from the spirit and scope of the invention. It is to be understood that no limitation with respect to the specific apparatus illustrated herein in tended or should be inferred. It is, of course, intended to cover by the appended claims all such modifications as fall within the scope of the claims.

The invention claimed is:

1. A watercraft comprising:

a body configured to be directly buoyantly supported on water, said body having a perimeter, said body having a longitudinal axis aligned with an intended forward direction of travel of said body through water;

a laterally extendable first deck portion selectively extendable in linear, sliding fashion from a position substantially within the perimeter of the body to a position extended substantially laterally outwardly of said perimeter of said body;

a pair of parallel, laterally arranged rails connected to the first deck portion, slidable relative to the body, and, when the first deck portion is in the extended position, said rails extending inwardly of the perimeter of said body from the first deck portion and supporting the first deck portion in a cantilevered manner off the body;

a second deck portion selectively extendable in linear, sliding fashion from a position substantially within the perimeter of said body to a position extended substantially laterally outwardly of said perimeter of said body, said second deck portion arranged to extend laterally in a direction opposite to said lateral extension of said first deck portion; and a pair of parallel, laterally arranged rails connected to the second deck portion, slidable relative to the body, and, when the second deck portion is in the extended position, said rails connected to the second deck portion extending inwardly of the perimeter of said body from the second deck portion and supporting the second deck portion in a cantilevered manner off the body; and wherein the first and second deck portions are adapted to be simultaneously selectively extendable, so as to counterbalance one another.

2. The watercraft according to claim 1, comprising a manual actuator for sliding said first deck portion and said second deck portion.

3. The watercraft according to claim 1, comprising a driving mechanism for selectively extending or retracting said first deck portion and said second deck portion laterally, said driving mechanism including a motor driving a pinion gear, and a rack having a toothed surface engaged to said pinion gear and fixed to said first deck portion, rotation of said pinion gear by said motor extending or retracting said first deck portion from said body.

4. The watercraft according to claim 1, comprising a driving mechanism for selectively extending or retracting said first deck portion and said second deck portion laterally, said drive mechanism comprising an electrical linear motor mounted to said body, and at least one of the rails extending from said first deck portion and at least one of the rails extending from said second deck portion having a plurality of magnetic elements along said rails, said elements driven by said linear motor to translate said rails.

5. The watercraft according to claim 1, comprising a driving mechanism for selectively simultaneously extending or retracting said first deck portion and said second deck portion laterally, said driving mechanism comprising a hydraulic cylinder, and at least one of the rails extending from said first deck portion and at least one of the rails extending from said second deck portion operatively connected to a piston, said piston located within said hydraulic cylinder, said hydraulic cylinder having hydraulic media ports on opposite ends such as to selectively move said piston in one of two opposite directions.

6. A watercraft comprising:

a hull having a longitudinal centerline aligned with an intended forward direction of travel of the watercraft through water, said hull having hull sidewalls which extend above the waterline to a main deck, and a keel arranged below the waterline, said keel containing a ballast to prevent tipping of said watercraft;

a passenger-supporting structure, including a horizontal surface, selectively extendable in sliding fashion laterally of the perimeter of the hull, wherein said passenger-supporting structure comprises a room extension which includes a floor, room sidewalls and a roof, said room extension located vertically to extend from said hull sidewalls, between the waterline and said main deck; and a pair of parallel, laterally arranged rails connected to the horizontal surface of the passenger-supporting structure, and a pair of parallel, laterally arranged rails connected to the roof of said room extension, said pairs of rails extending from the passenger-supporting structure in a direction toward one of the hull sidewalls, and, when the passenger-supporting structure is extended of the perimeter of the hull, said rails connected to the horizontal surface and to the roof supporting the passenger-supporting structure in a cantilevered manner off the hull.

7. The watercraft according to claim 6, further comprising:

a second passenger-supporting structure, including a horizontal surface, selectively extendable in sliding fashion laterally of the perimeter of the hull in a direction opposite to the first passenger-supporting structure, wherein said second passenger-supporting structure comprises a second room extension which includes a floor, room sidewalls and a roof, said second room extension located vertically to extend from said hull sidewalls, between the waterline and said main deck; and a pair of parallel, laterally arranged rails connected to the horizontal surface of the second passenger-supporting structure, and a pair of parallel, laterally arranged rails connected to the roof of said second room extension and extending from the second passenger-supporting structure in a direction toward one of the hull sidewalls, and, when the second passenger-supporting structure is extended laterally of the perimeter of the hull, said rails connected to the horizontal surface and to the roof supporting the passenger-supporting structure in a cantilevered manner off the hull;

said first and second room extensions adapted to be simultaneously selectively extendable, so as to counterbalance one another.

8. A watercraft comprising:

a body fashioned for being directly supported on water, said body having a perimeter, said body having a longitudinal axis aligned with an intended forward direction of travel of said body through water;

a first enclosed room portion horizontally extendable in sliding fashion from a position substantially within the perimeter of the body to a position extended substantially outwardly of said perimeter of said body;

a pair of parallel, laterally arranged rails connected to the first enclosed room portion, slidable relative to the body, and, when the first enclosed room portion is extended laterally of the perimeter of the body, said rails extending from the first enclosed room portion in a direction inwardly of the perimeter of the body and supporting the first enclosed room portion in a cantilevered manner off the body;

a second enclosed room portion horizontally extendable in sliding fashion in a direction opposite to the first enclosed room portion from a position substantially within the perimeter of the body to a position extended substantially outwardly of said perimeter of said body;

a pair of parallel, laterally arranged rails connected to the second enclosed room portion, slidable relative to the body, and, when the second enclosed room portion is extended laterally of the perimeter of the body, said rails extending from the second enclosed room portion in a direction inwardly of the perimeter of the body and supporting the second enclosed room portion in a cantilevered manner off the body; and wherein the first and second enclosed room portions are adapted to be simultaneously selectively extendable, so as to counterbalance one another.

9. The watercraft according to claim 8, comprising a manual actuator for sealing each of said first and second room portions.

10. The watercraft according to claim 8, comprising a driving mechanism for simultaneously selectively extending or retracting said first and second room portions, said driving mechanism including a motor driving a pinion gear, a first rack having a toothed surface engaged to said pinion gear and fixed to said first room portion, a second rack having a toothed surface engaged to said pinion gear and fixed to said second room portion, rotation of said pinion gear by said motor extending or retracting said room portions from said body.

11. The watercraft according to claim 8, comprising a driving mechanism for secretively simultaneously extending or retracting said room portions, said drive mechanism comprising an electrical linear motor mounted to said body, and at least one of the parallel, laterally arranged rails connected to each of said room portions having a plurality of magnetic elements along said rails said elements driven by said linear motor to translate said rails.

12. The watercraft according to claim 8, comprising a driving mechanism for simultaneously selectively extending or retracting said first and second room portions said driving mechanism comprising a hydraulic cylinder, and at least one of the parallel, laterally arranged rails connected to each of said room portions operatively connected to a piston, said piston located within said hydraulic cylinder, said hydraulic cylinder having hydraulic media ports on opposite ends such as to selectively move said piston in one of two opposite directions.

13. The watercraft according to claim 8, wherein each of said room portions includes a floor, a room sidewalls, and a roof, each said room portion located vertically to extend from within a vertical dimension of said body, between the waterline and a top of said body.

14. The watercraft according to claim 13, wherein said parallel, laterally arranged rails extend from said floor of the respective room portions.

15. The watercraft according to claim 14, further comprising:

a second pair of parallel, laterally arranged rails connected to the roof of said first room extension located above the pair of rails extending from the floor of the first room portion and further supporting the first enclosed room portion in a cantilevered manner off the body when the first enclosed room portion is extended laterally of the perimeter of the body; and a second pair of parallel, laterally arranged rails connected to the roof of said second room extension located above the pair of rails extending from the floor of the second room portion and further supporting the second enclosed room portion in a cantilevered manner off the body when the second enclosed room portion is extended laterally off the perimeter of the body.

* * * * *

UNITED STATES PATENT AND TRADEMARK OFFICE

CERTIFICATE OF CORRECTION

PATENT NO. : 6,606,957 B2
DATED : August 19, 2003
INVENTOR(S) : David G. Matthews It is certified that error appears in the above-identified patent and that said Letters Patent is hereby corrected as shown below:

Column 8,
Line 11, delete “sealing” and substitute -- sliding --.

Signed and Sealed this

Eighth Day of June, 2004

JON W. DUDAS
*Acting Director of the United States Patent and Trademark Office*